US005782295A

United States Patent [19]

Kato et al.

[11] Patent Number: 5,782,295

[45] Date of Patent: Jul. 21, 1998

[54] HEAT EXCHANGER

[75] Inventors: Soichi Kato; Takashi Sugita, both of Saitama, Japan

[73] Assignee: Zexel Corporation

[21] Appl. No.: 811,052

[22] Filed: Mar. 4, 1997

[30] Foreign Application Priority Data

Mar. 14, 1996 [JP] Japan ..... 8-058129

[51] Int. Cl.[6] ..... F28F 9/04

[52] U.S. Cl. ..... 165/174; 165/176

[58] Field of Search ..... 165/153, 173, 165/174, 176; 29/890.052

[56] References Cited

U.S. PATENT DOCUMENTS 4,936,381 6/1990 Alley ..... 105/176

5,042,578 8/1991 Tanabe ..... 165/174

5,123,483 6/1992 Tokutake et al. ..... 165/176

5,125,454 6/1992 Creamer et al. ..... 165/173

*Primary Examiner*—Leonard R. Leo

*Attorney, Agent, or Firm*—Kanesaka & Takeuchi

[57] ABSTRACT

In a heat exchanger which comprises by alternately laminating a plurality of tubes 2, 2 and fins 3, 3, communicatively connecting a header tank 4 to both ends of the laminated tubes, forming slits 11 at required points in the header tanks, and providing partition plates 9 in the slits to flow a heat-exchanging medium; recesses 12 are formed on the inner faces of the header tanks and near the slits where the partition plates 9 are positioned, and the partition plates 9 are provided with projections 15 to correspond with the recesses 12. Walls 4*a*, which are crushed when the partition plate 9 is inserted, are formed between the recess 12 and the slit 11.

2 Claims, 3 Drawing Sheets

FIG. 2
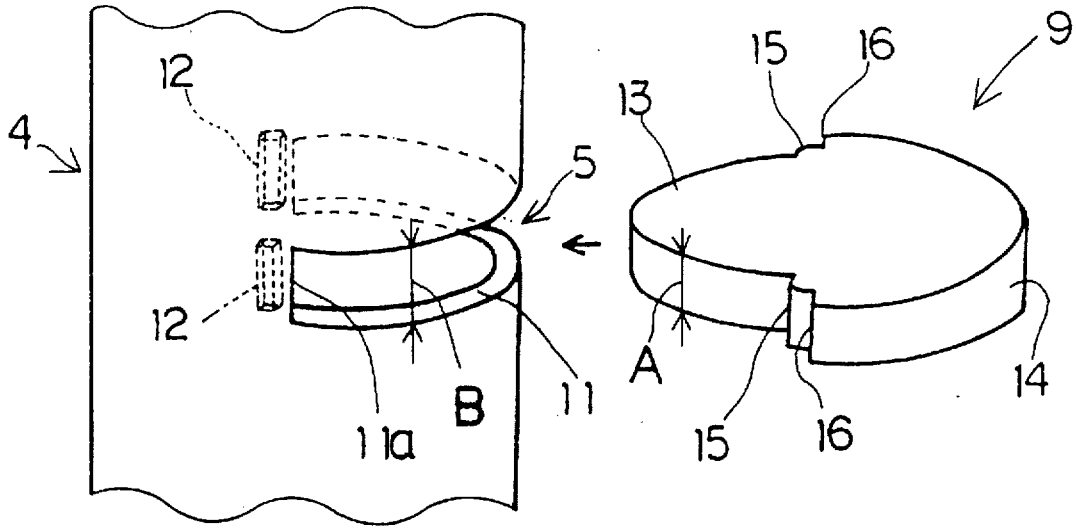
FIG. 4
FIG. 3
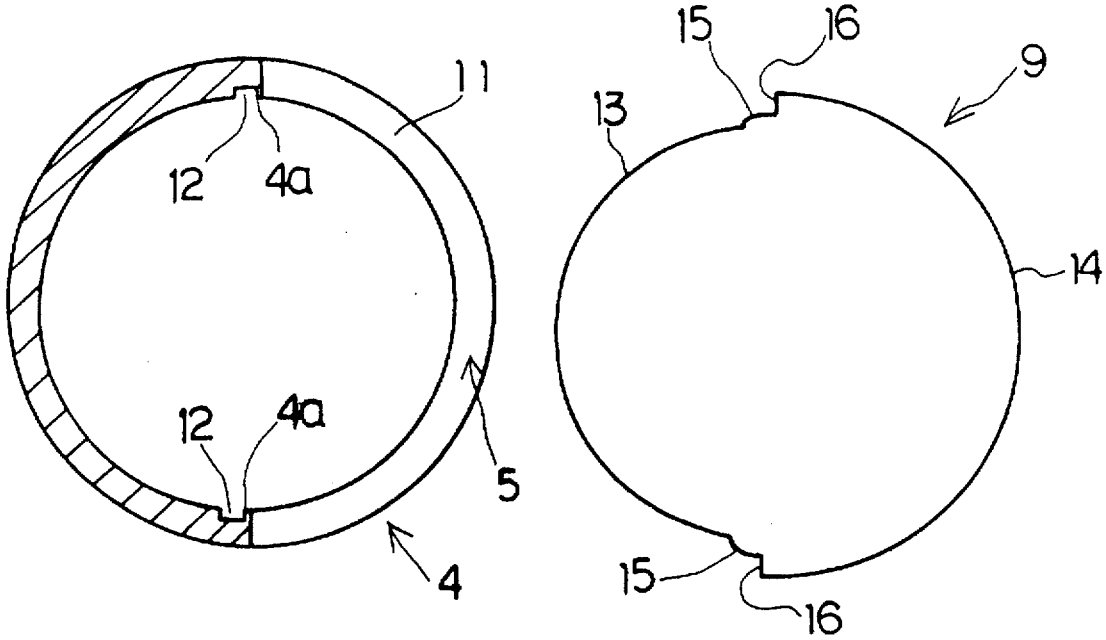

HEAT EXCHANGER

BACKGROUND OF THE INVENTION

1. Field of the Invention

This invention relates to a parallel flow type heat exchanger, and more particularly to a secure temporarily assembling of partition plates, which are provided to divide the interior of header tanks in a longitudinal direction, at the time of brazing.

2. Description of the Related Art

Generally, a parallel flow type heat exchanger has a plurality of flat tubes and corrugated fins alternately laminated and both ends of the laminated tubes inserted and connected to insertion ports formed in the header tanks (header pipes).

The header tank is generally formed by rolling a single plate having a given shape into a cylinder, closing upper and lower openings of the rolled header tank with a blanking plate, and providing partition plates at predetermined points of the header tank to divide its interior in a longitudinal direction.

Such partition plates are disclosed in, for example, Japanese Utility Model Publication No. Hei 3-32944, Japanese Utility Model Laid-Open Publication No. Hei 5-52578, and Japanese Patent Laid-Open Publication No. Hei 4-254194. Specifically, such partition plates are generally inserted into and fixed to the slits formed in the header tanks. These partition plates comprise an inner diameter section formed corresponding to the transverse cross-sectional inner shape of the header tank and an outer diameter section corresponding to the transverse cross-sectional outer shape of the header tank, and stepped portions are provided at a boundary between the inner diameter section and the outer diameter section.

When the partition plate is temporarily assembled, the inner diameter section of the partition plate is contacted to the inner face of the header tank, and the end faces of right and left stepped portions are positioned in contact with right and left end faces of the slit and brazed integrally.

And, in such a parallel flow type heat exchanger, a heat-exchanging medium is meandered a plurality of times to flow between inlet and outlet joints disposed on the header tanks.

In the header tank structure of the above conventional heat exchanger, the slits formed on the header tanks may have a dimensional deviation when forming, causing a difficulty in securely assembling the partition plates. And, there was a disadvantage that the partition plates are disconnected or slanted when brazing due to the dimensional deviation of the slots.

Therefore, workability was poor, a bypass leak was caused in the heat exchanger, thus the performance of the heat exchanger was lowered.

In view of the above disadvantage, it is proposed to temporarily assemble in advance by spot welding with argon or the like after inserting the partition plates into the slits of the header tanks. But, this method has disadvantages that workability is poor and a production cost is high because of the increase of processes, tools and machines.

And, since the conventional partition plates are designed to be slightly smaller than the slit width, they may be adversely affected by the dimensional deviation of the slits. In view of this disadvantage, the above-described Japanese Patent Laid-Open Publication No. Hei 4-254194 has proposed a superposed partition plate. Specifically, a superposed partition plate 17 has plates 18, 19, which have the same shape with the transverse cross-sectional shape of the header tank, symmetrically joined at a joint 20 as shown in FIG. 7. And, the plates 18, 19 are provided with ribs 18*a*, 19*a* at a portion to face with the outer peripheral surface of the header tank. The partition plate 17 is bent at the joint 20 to superpose the plates 18, 19, thereby forming the superposed partition plate 17. These superposed partition plates are configured to utilize the elasticity or the like of the plate material to fit into the slits.

But, these partition plates had disadvantages that the production processes are increased to make the superposed shape, leading to the increase of costs, and since they are bent at the joint to form the superposed shape, the leading ends to be bent protrude from the inner diameter sections of the partition plates and a gap is formed between the inner face of the header tank and the partition plate, inducing a brazing failure.

It is also known to use a projection which is formed when the plate is bent at the joint. Specifically, a small opening is formed in the header tank so to correspond with the projection, and the projection is inserted into the small opening when the partition plate is inserted into the slit. But, this method also has a disadvantage that this partition plate is bent in the same way as the one described above, and the number of production processes is increased.

And, as described in Japanese Utility Model Laid-Open Publication No. Hei 5-52578, a temporally assembling method is provided in which the partition plate is partly modified to form a projection which is slightly larger than the slit, and the partition plate having the projection is press-fitted into the slit to force the projection contact to the inner face of the slit. But, since the partition plate is generally formed by a press, the projection is formed by another means separate from the press working. Therefore, the production processes are increased as in the production of the partition plates, and the production cost is raised.

SUMMARY OF THE INVENTION

Accordingly, it is an object of the present invention to provide a heat exchanger which has partition plates and header tanks securely assembled temporarily in a process for producing the header tanks and the partition plates.

According to the invention there is provided a a heat exchanger which comprises by alternately laminating a plurality of tubes and fins, communicatively connecting a header tank to both ends of the laminated tubes, forming slits at required points in the header tanks, and providing partition plates in the slits to flow a heat-exchanging medium; wherein recesses are formed on the inner faces of the header tanks and near the slits where the partition plates are positioned, and the partition plates are provided with projections to correspond with the recesses.

When the heat exchanger is configured as described above, in inserting the partition plates into the slits, the projections formed on the partition plate are engaged with the recesses formed on the header tank, thus the partition plates are temporarily assembled with the inner faces of the header tanks. And, the projections of the partition plates can be produced with ease by the press working or the like without increasing the production processes.

According to another aspect of the invention there is provided a heat exchanger, wherein walls, which are crushed when the partition plate is inserted, are formed between the recess and the slit.

When the heat exchanger is configured as described above, by inserting the partition plates into the slits, the projections of the partition plates are forced to contact with the walls of the header tanks to crush the walls with force, the partition plates are securely assembled temporarily with the inner faces of the header tanks by this press-crushing, namely by such a high pressure contacting to crush with force, so that the partition plates can be prevented from being come off.

As described above, the present invention does not need to perform a spot welding or to make the partition plates in the form suitable for superposing to temporarily assemble the partition plates with the header tanks prior to brazing like the conventional methods, so that the heat exchanger can be produced by securely assembling the partition plates with the header tanks without increasing the production processes.

BRIEF DESCRIPTION OF THE DRAWINGS

FIG. 2 is a diagram showing a header pipe and a partition plate;

FIG. 3 is a sectional view taken at a slit of the header pipe;

FIG. 4 is a plan view showing a partition plate;

DESCRIPTION OF PREFERRED EMBODIMENT

A specific embodiment of the invention will now be described with reference to the accompanying drawings.

Figure 1:
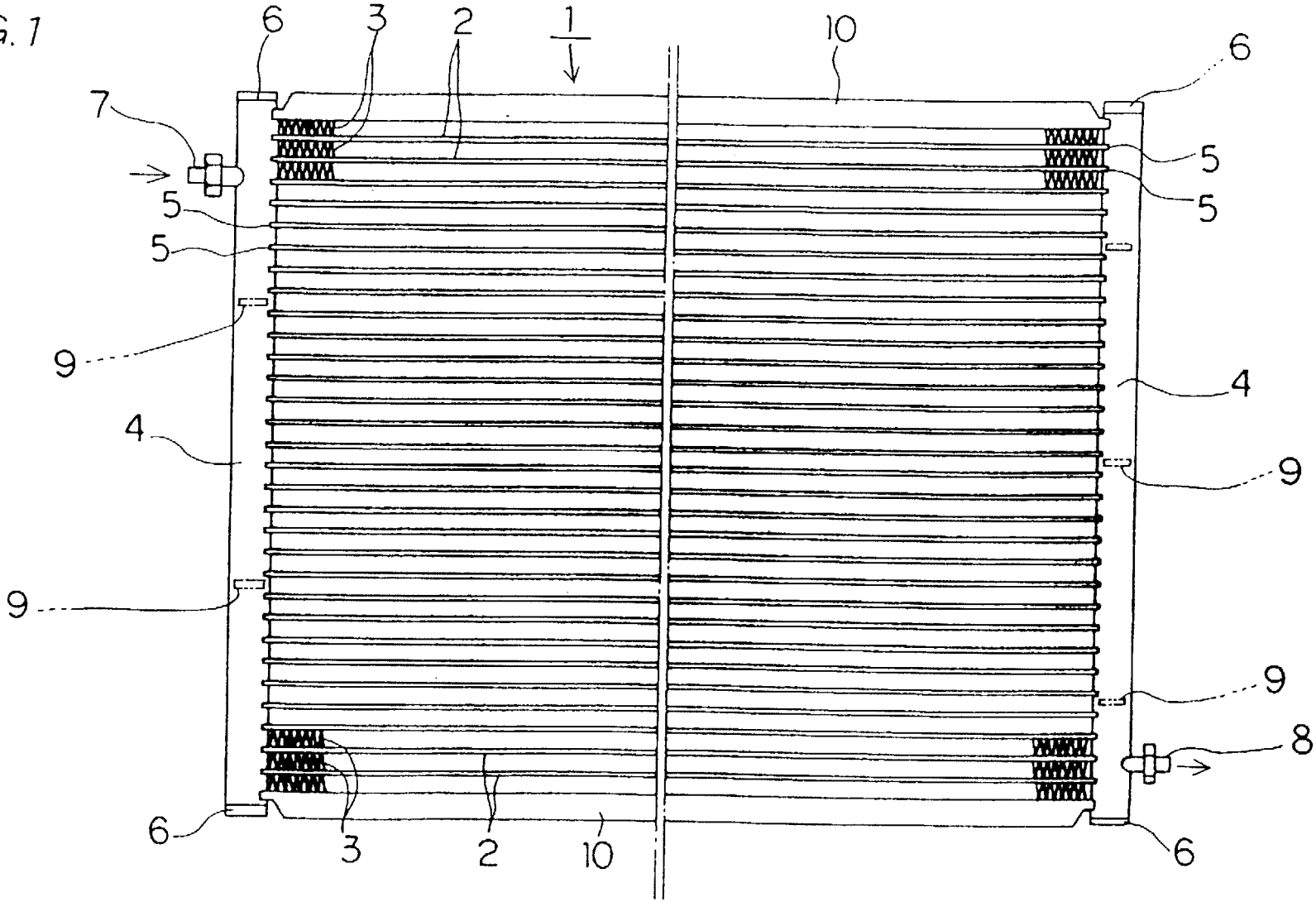
FIG. 1 is a front view of a heat exchanger according to one embodiment of the invention.
Figure 5:
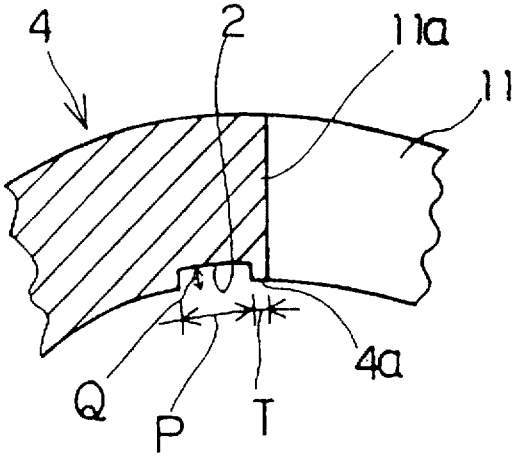
FIG. 5 is a diagram showing a recess and a wall of a header pipe.
Figure 6:
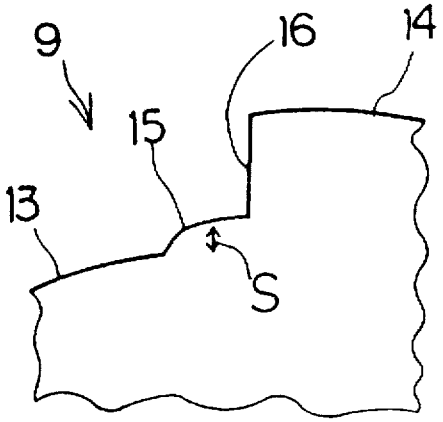
FIG. 6 is a diagram showing a projection and a stepped portion of a partition plate.
Figure 7:
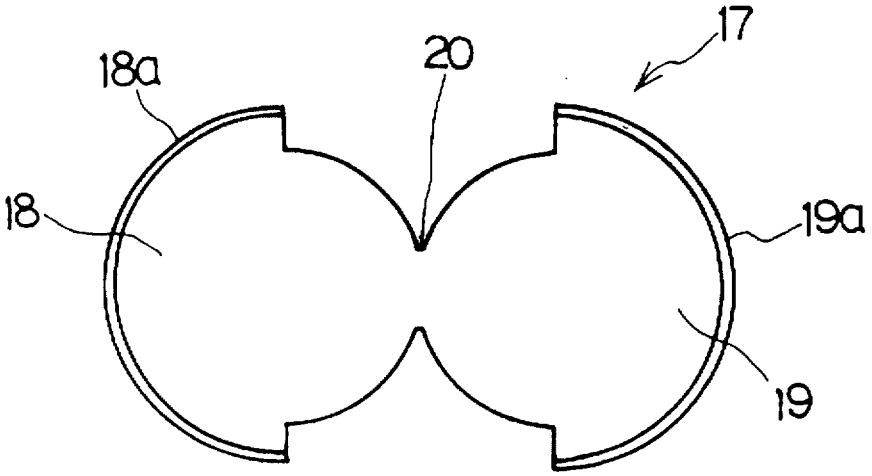
FIG.7 PRIOR ART
FIG. 7 is a plan view showing a superposed partition plate of prior art.

In FIG. 1, a heat exchanger 1 has a plurality of flat tubes 2 and corrugate fins 3 alternately laminated, and both ends of the laminated flat tubes 2 are connected to header tanks 4 by being inserted into tube insertion ports 5 formed on the header tanks 4. Upper and lower end openings of the header tanks 4 are closed with a blanking cap 6, an inlet joint 7 is provided on one of header pipes, an output joint 8 is provided on the other header pipe, and partition plates 9 are provided at prescribed points inside the header pipes. And, a heat-exchanging medium is meandered a plurality of times to flow from the inlet joint 7 to the outlet joint 8. A side plate 10 having a U-shaped transverse cross-sectional shape is provided at the top and bottom ends of the laminated flat tubes 2.

The header tank 4 is formed by rolling a plate having a given size and its both sides clad with a brazing filler metal into a cylinder and brazing to connect the both ends of the rolled plate.

In FIG. 2 through FIG. 6, slits 11 in which the partition plate 9 is fitted are formed at required points of the header tank 4. The slit 11 has an opening width B which is equal to a plate thickness A of the partition plate 9 or slightly larger than the thickness A to a level allowing the insertion of the partition plate 9. In this embodiment, the plate thickness A of the partition plate is set to about 1.4 to 1.5 mm, and the opening width B of the slit 11 to about 1.5 mm.

The partition plate 9 is shaped to have a size corresponding to the transverse cross section of the header tank 4 and has an inner diameter section 13 which leading end is formed to conform with the inner face of the header tank and an outer diameter section 14 formed to conform with the outer periphery surface of the header tank corresponding to its transverse cross section; and projections 15 which engage with recesses 12 to be described afterward are formed between the inner diameter section 13 and the outer diameter section 14. And, stepped portions 16 are also formed between the inner diameter section 13 and the outer diameter section 14 in the same way as in the conventional product.

In this embodiment, recesses 12 having a width P are formed on the inner face of the header tank 4 and near the slit 11 where the partition plate 9 is positioned. The recess 12 is formed apart from an end face 11*a* by a width T from the end face 11*a* of the slit 11. Therefore, there is a wall 4*a* having the width T between the end face 11*a* of the slit 11 and the recess 12.

In this embodiment, the width T of the wall 4*a* is assumed to be crushed by the projection 15 formed on the partition plate 9 to be described afterward. Therefore, if the width T is excessively large, the projection 15 cannot crush the wall 4*a* to enter, and a gap may be formed between the partition plate 9 and the inner face of the header pipe 4, causing a failure in brazing. Taking such a situation into account, the width T of the wall 4*a* is practically optimum to be 0.1 to 0.3 mm. For example, the width T is set to about 0.2 mm in this embodiment. And, the sum of the width T and the width P is set to be equal to a length of the projection 15, namely about 2 mm in this embodiment. Besides, a depth Q of the recess 12 and a height S of the projection 15 are determined to be about 0.2 mm in this embodiment.

And, a vertical size of the recess 12 in FIG. 2 is determined to be slightly smaller than the thickness A of the partition plate 9. When the partition plate 9 is inserted into the slit 11 of the above-described header pipe 4, the projections 15 formed on the partition plate 9 push the walls 4*a* of the header tank 4 to fit in the recesses 12. At this time, the projections 15 come in contact with the walls 4*a* to crush the walls and fit in the recesses; the stepped portions 16 are contacted with the end faces 11*a* of the slit 11; and the inner diameter section 13 comes in contact with the inner face of the header tank 4. Thus, the partition plate 9 is securely assembled with the slit 11 temporarily, and then brazed.

In the embodiment described above, when the partition plate is inserted into the slit, the projections formed on the partition plate are engaged with the recesses formed on the header tank, thus the partition plate is temporarily fitted into the header tank. And, the projections of the partition plate can be produced easily by the press working or the like without increasing the number of processes. When the partition plate is inserted into the slit, the projections formed on the partition plate are forced to contact with the walls formed on the header tank to crush these walls, and the partition plate is securely assembled temporarily with the inner faces of the header tank by this press-crushing, namely by such a high pressure contact to crush with force, so that the partition plate can be prevented from coming off.

As described above, according to the invention, in a heat exchanger which comprises by alternately laminating a plurality of tubes and fins, communicatively connecting header tanks to both ends of the laminated tubes, forming slits at required points in the header tanks, and providing partition plates in the slits to flow a heat-exchanging medium; recesses are formed on the inner faces of the header tanks and near the slits where the partition plates are positioned, and the partition plates are provided with projections to correspond with the recesses. Therefore, when the partition plate is inserted into the slit, the projections formed on the partition plate are engaged with the recesses formed on the header tank, thus the partition plate is temporarily assembled into the header tank. And, the projections of the partition plate can be produced easily by the press working or the like without increasing the number of processes.

According to the invention, the heat exchanger which comprises a wall, which is crushed when the partition plate is inserted, formed between the recess and the slit. Therefore, when the partition plate is inserted into the slit, the projections of the partition plate are forced against the walls formed on the header tank to crush the walls, and the partition plate is securely assembled into the header tank temporarily by the pressure contacting by this crushing. Thus, the partition plate can be prevented from coming out.

As described above, since the present invention can temporarily assemble the partition plate with the header tank before brazing without requiring a spot welding or the partition plate formed into a superposed design as in a conventional method, a heat exchanger can be obtained in which the partition plate can be assembled with the header tank securely without increasing the number of processes.

What is claimed is:

1. A heat exchanger comprising, a plurality of alternately laminated tubes and fins;

a pair of header tanks fluidly connected to ends of the laminated tubes;

at least one slit formed in one of the header tanks, recesses formed in an inner face of said one header tank and spaced from the slit; and a partition plate having projections corresponding to the recesses for positioning the partition plate in the slit to redirect the flow of heat exchanging medium.

2. The heat exchanger according to claim 1, wherein crush walls are located between the recesses and the slit to facilitate temporary assembly of the partition plate and said one header tank prior to brazing.

* * * * *